US006202563B1

(12) United States Patent
Tarassoff et al.

(10) Patent No.: US 6,202,563 B1
(45) Date of Patent: Mar. 20, 2001

(54) LOADING AND UNLOADING PROCEDURE FOR CARS AT STATIONS OF AN AERIAL CABLE TRANSPORT INSTALLATION

(75) Inventors: Serge Tarassoff, Grenoble; Gilles Vibert, Coublevie, both of (FR)

(73) Assignee: Pomagalski SA (FR)

( * ) Notice: Subject to any disclaimer, the term of this patent is extended or adjusted under 35 U.S.C. 154(b) by 0 days.

(21) Appl. No.: 09/206,945

(22) Filed: Dec. 8, 1998

(30) Foreign Application Priority Data

Dec. 10, 1997 (FR) ..... 97 15635

(51) Int. Cl.[7] ..... B61B 1/00
(52) U.S. Cl. ..... 104/28; 104/178
(58) Field of Search ..... 104/27, 28, 173.1, 104/178, 179, 184, 238, 239, 249

(56) References Cited

U.S. PATENT DOCUMENTS 4,627,361 * 12/1986 Tarassoff ..... 104/28
4,712,486 * 12/1987 Tarassoff ..... 104/173.1
4,843,968 * 7/1989 Rikli ..... 104/27
5,105,745 * 4/1992 Tarassoff ..... 104/179
5,575,215 * 11/1996 Egli et al. ..... 104/173.1

FOREIGN PATENT DOCUMENTS

2583363 * 12/1986 (FR) .
2605574 * 4/1988 (FR) .
0557179 * 8/1993 (FR) .

* cited by examiner

*Primary Examiner*—Mark T. Le
(74) *Attorney, Agent, or Firm*—Parkhurst & Wendell, LLP

(57) ABSTRACT

A process for both storing vehicles of an aerial cable transport installation and taking vehicles from stored stock in a station. The vehicles are suspended by disengagable coupling clamps to the cable. The installation is shut down by braking and stopping a first car in the vicinity of a station exit, transferring the other cars in the station during the first step, braking and stopping a second car, transferring the rest of the cars in the station during the preceding step, and repeating the last two steps to use the entire station length to store cars. In one embodiment, the cable speed is approximately constant during the second and fourth steps of the process.

6 Claims, 5 Drawing Sheets

LOADING AND UNLOADING PROCEDURE FOR CARS AT STATIONS OF AN AERIAL CABLE TRANSPORT INSTALLATION

BACKGROUND OF THE INVENTION

1. Field of the Invention

The invention relates to the technical field of aerial cable transport installations, notably cars or seats, suspended by coupling clamps to the cable, said clamps being disengageable.

More particularly, the invention relates to a process enabling both the storage and the taking from stock of the vehicles of an aerial cable installation, this process being implemented during the installation shutdowns, for example during a slack period or at the end of the day.

2. Discussion of Prior Art

The storage of the vehicles of an aerial cable transport entails numerous technical problems that have been variously approached in the prior art.

EP-369.981 describes a storage installation for cable cars. This installation comprises a storage rail pivoting around a horizontal shaft, the seats or cars motion being induced, along the storage rail, by the gravitational force.

The storage zone described in EP-369.981 occupies a considerable ground surface, is thus cumbersome nearby an end station of the installation, and is expensive.

FR-2.598.373 describes an arrangement of transfer tracks and/or garage tracks for a disengageable car or chair lift. If this arrangement avoids the bumping between vehicles while maintaining a minimal space between them, it induces an encumbered space and an additional cost for the transport installation.

FR-2.654.052 describes a process for the starting-up and shutting-down of an aerial cable transport installation.

Contrarily to most of the installations known in the prior art, the installation described in FR-2.654.052 is devoid of a large size shed adjacent to the departure and arrival stations for the storage of cars or seats on branch tracks.

These sheds are expensive, notably in mountainous or rough regions.

In the facility described in FR-2.654.052, the cars are stored in the stations, using a part of the launching device and a part of the deceleration device, each of these devices comprising two sections, one of which being the storage one.

The installation described in FR-2.654.052 has many drawbacks.

In particular, the storage zone of the cars is of limited dimensions since it is necessary, according to this facility, to maintain an acceleration or a deceleration zone to reduce the speed of the vehicle.

Moreover, the utilization of motors synchronized to the speed of the cable which transmit the movement to the pneumatics which have between them a speed ratio of 1, and the fact that the storage zone functions step by step to enable the storage of cars at regular intervals generates a substantial investment both in electronic and mechanical management equipment.

BRIEF SUMMARY OF THE INVENTION

The invention relates to a process enabling both the storage and taking from the stock of the vehicles of aerial cable transport installations, which does not present the drawbacks known in the prior art.

To this end, the invention relates, according to a first embodiment, to a process for the shutdown of an aerial transport installation with cables, one of which at least being a towing cable, said installation comprising a plurality of cars fixed to the cable(s) through at least one disengageable clamp, said process including the following steps:

a/ braking and stopping of a first car in the vicinity of the exit of the station, via the engagement of a means for braking and stopping the car;

b/ transfer of the other cars to be found in the station during step a/, the speed of the cable being approximately constant;

c/ braking and stopping of a second car, at a certain distance from the first car, via the engagement of a means for braking and stopping a car, associated to the second car;

d/ transfer of the other cars to be found in the station during step c/, the speed of the cable being approximately constant;

e/ repetition of the steps c/ and d/, it being possible to use the entire length of the station for the storage of the cars.

The invention relates, according to a second embodiment to a process for the startup of an aerial transport installation with cables, one of which at least being a towing cable, said installation comprising a plurality of cars fixed to the cable(s), said process including the following steps:

a/ launching of a first car (2*a*) located at the beginning of the acceleration section by disengagement of a car stopping means and by coupling said car (2*a*) to the towing cable;

b/ transfer of the other cars to be found in the station during step a/, the speed of the cable being approximately constant;

c/ launching of a second car (2*b*) located at the beginning of the acceleration section, by disengagement of a car stopping means and coupling of said car (2*b*) to the towing cable;

d/ transfer of the other cars to be found in the station during step c/, the speed of the cable being approximately constant;

e/ repetition of steps c/ and d/, until all the cars are rhythmically placed once again on the installation.

The invention also relates to an aerial cable transport installation implementing said process.

BRIEF DESCRIPTION OF THE DRAWINGS

Other characteristics and advantages of the invention will become apparent upon reading of the following description of the embodiments, description which will be given with reference to the appended drawings where.

DETAILED DESCRIPTION OF THE INVENTION

The following description will be made while referring to a cable car with disengageable clamps on a cable.

Those skilled in the art will understand that the invention is easily applicable to two-cabled or multi-cabled installations, comprising cars, telpher carriers, seats for transporting materials, things or passengers.

In the rest of this document to simplify, we will only refer to cars.

In the Figures, a station of a cable car having a bearing towing cable 1 comprises an end pulley with a vertical axis (not shown), on which passes the cable 1.

To cable 1 are coupled cars 2.

At the entrance of the station, the cars are uncoupled from cable 1, by a known method.

Similarly, at the exit of the station, the cars are recoupled to cable 1, by a known method.

A support carriage of at least one disengageable clamp is associated to each car.

The carriage is equipped with rollers and rolls into the station after being uncoupled from cable 1, on a transfer rail.

According to an embodiment, the carriage is driven by pneumatic tires, acting on a friction side of the carriage.

According to an embodiment, the pneumatic tires are placed onward from the entrance 3 of the station for decelerating the cars 2 uncoupled from cable 1 up to the exit 4 of the station, for accelerating the cars 2 before their recoupling to cable 1.

According to another embodiment, it is planned to install a chain conveyor in the station contour.

FIGS. 1 to 4 illustrate the progressive storage of 14 cars at the end of the station, according to an embodiment of the invention.

Figure 1:
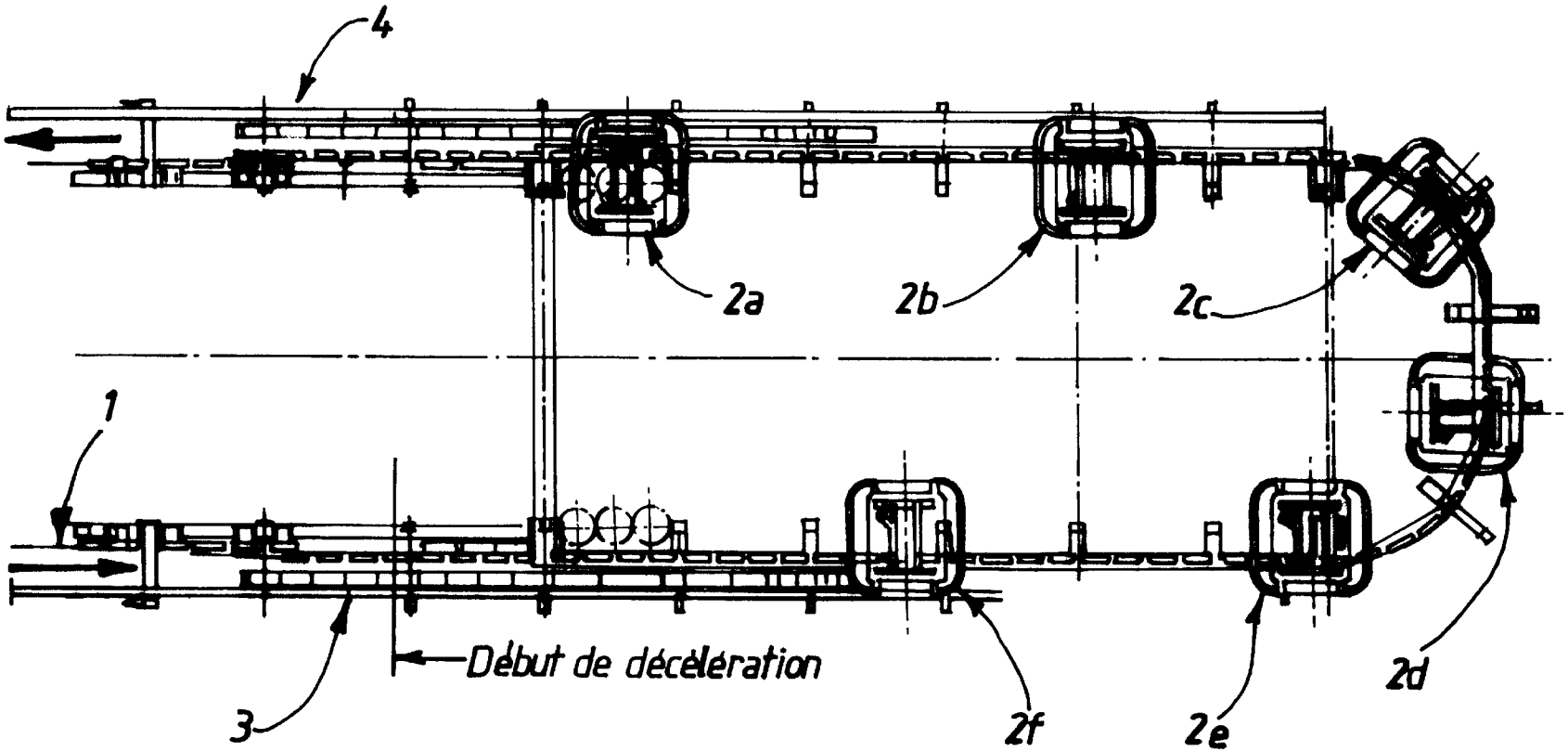
FIGS. 1 to 4 show the different phases of the cars storage in the station according to an embodiment of the invention.

In FIG. 1, the car 2*a* is already in a storage position. A friction clutch system, associated to a brake enables to stop the car 2*a* to the desired location.

According to another embodiment, a motor acts instead of said friction clutch system, and is possibly associated with a brake.

The transmission of the necessary efforts for inciting the driving system of the cars, downstream and upstream from the storage zone, does not depend on said clutch system so that the storage of the car 2*a*, then of the following cars 2*b*, 2*c*, 2*d* does not disturb the operating of the remaining installation, particularly the acceleration, deceleration and dragging systems.

Therefore the invention can be implemented on existing installations, not initially designed for the storage of vehicles in a station.

In particular, the mechanisms ensuring the disengaging, deceleration, acceleration and engaging of vehicles, which are mainly formed by pneumatic ramps, are compatible with the invention.

The invention is also compatible with an installation in which the motion drive is direct on the cable, the speed being modified via the pneumatics.

The structure of these devices, of a known type, will be shortly summarized hereafter.

These devices are such that the pneumatics drive the vehicles by adherence above the clamps.

On the arrival side and departure side, the pneumatics ramp is usually divided into two branches.

According to an embodiment, each of these branches is coupled to a back-geared motor with an adjustable speed by a variation of frequency for example, and each pneumatic drives the next one via a trapezoidal belt transmission, for example.

The reduction ratio between each pneumatic is 1 and all the pneumatics of the ramp rotate at the same speed.

In these installations, the deceleration and acceleration are obtained through the speed variation of the back-geared motors.

Under operation, the two branches of the ramp work like a single ramp. For this purpose, they are coupled by an electromagnetic clutch and are driven by the two back-geared motors whose respective speeds are then synchronized.

If one of the two back-geared motors stops, the electromagnetic engagement still couples both branches of the ramp and the totality of the pneumatics are driven by one back-geared motor only.

For the uncycling of the cars to be stored on the tracks as well as for the recycling, both branches of the ramp are uncoupled and are driven by their own back-geared motors, according to the program elaborated for these configurations.

The conveyor chain in the (station) contour is also driven by a variable speed back-geared motor.

According to another embodiment, each branch is coupled to a steady speed back-geared motor, the deceleration and the acceleration being obtained via the existence of speed ratios between the back-geared motors.

The invention enables to preserve the principle of reduction or increase of speed through the modification of the speed ratios between the pneumatics, thus maintaining the direct motion drives on the cable.

Figure 2:
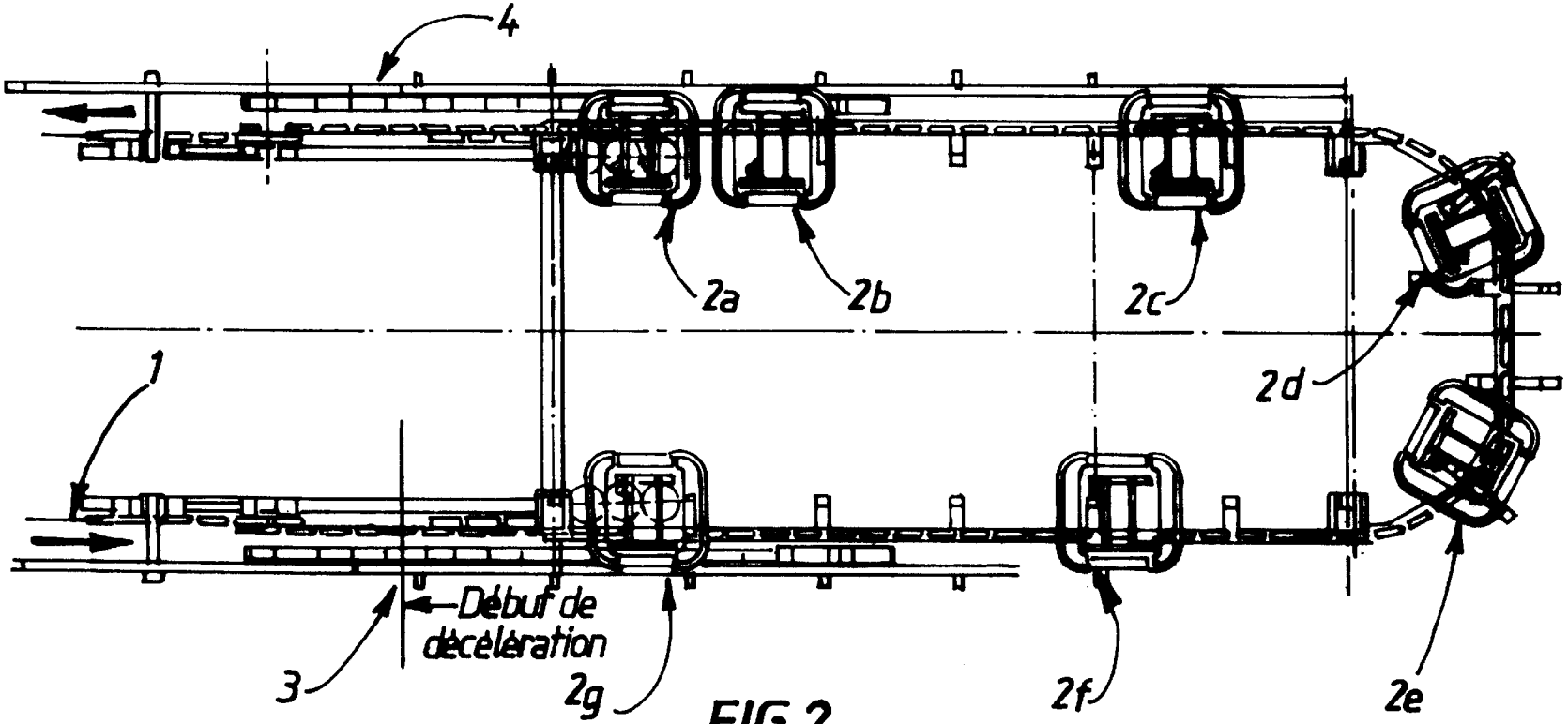

FIG. 2 illustrates an intermediate storage situation in which the car 2*b* is stopped in the proximity of car 2*a*.

The distance separating the cars 2*a*,2*b* . . . in the stations, during the storage phase, can be predetermined and modified as requested.

Figure 3:
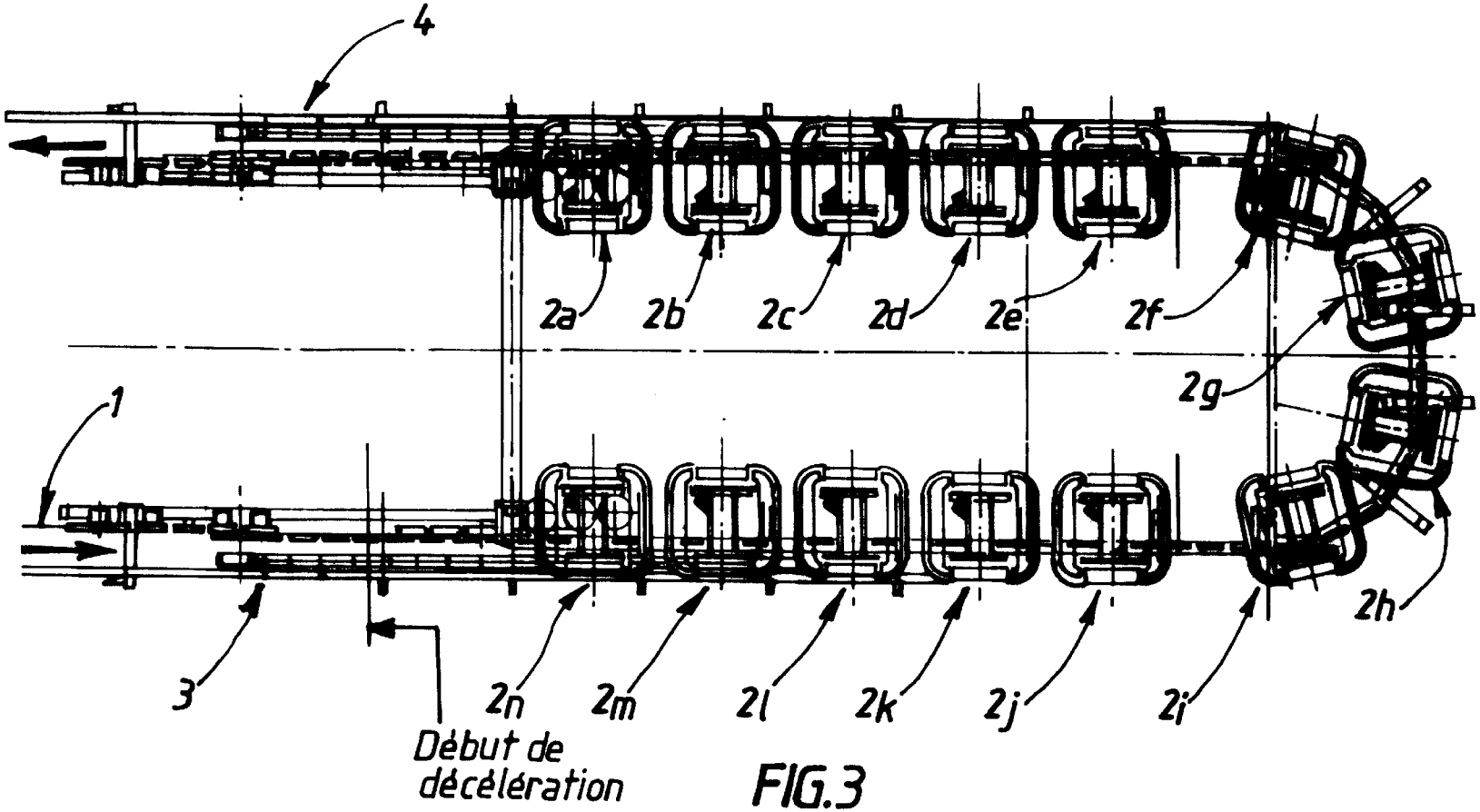

FIG. 3 illustrates the ultimate stage of storage in which the 14 cars, in the presented embodiment, are stored in the station, in the voltage station.

Figure 4:
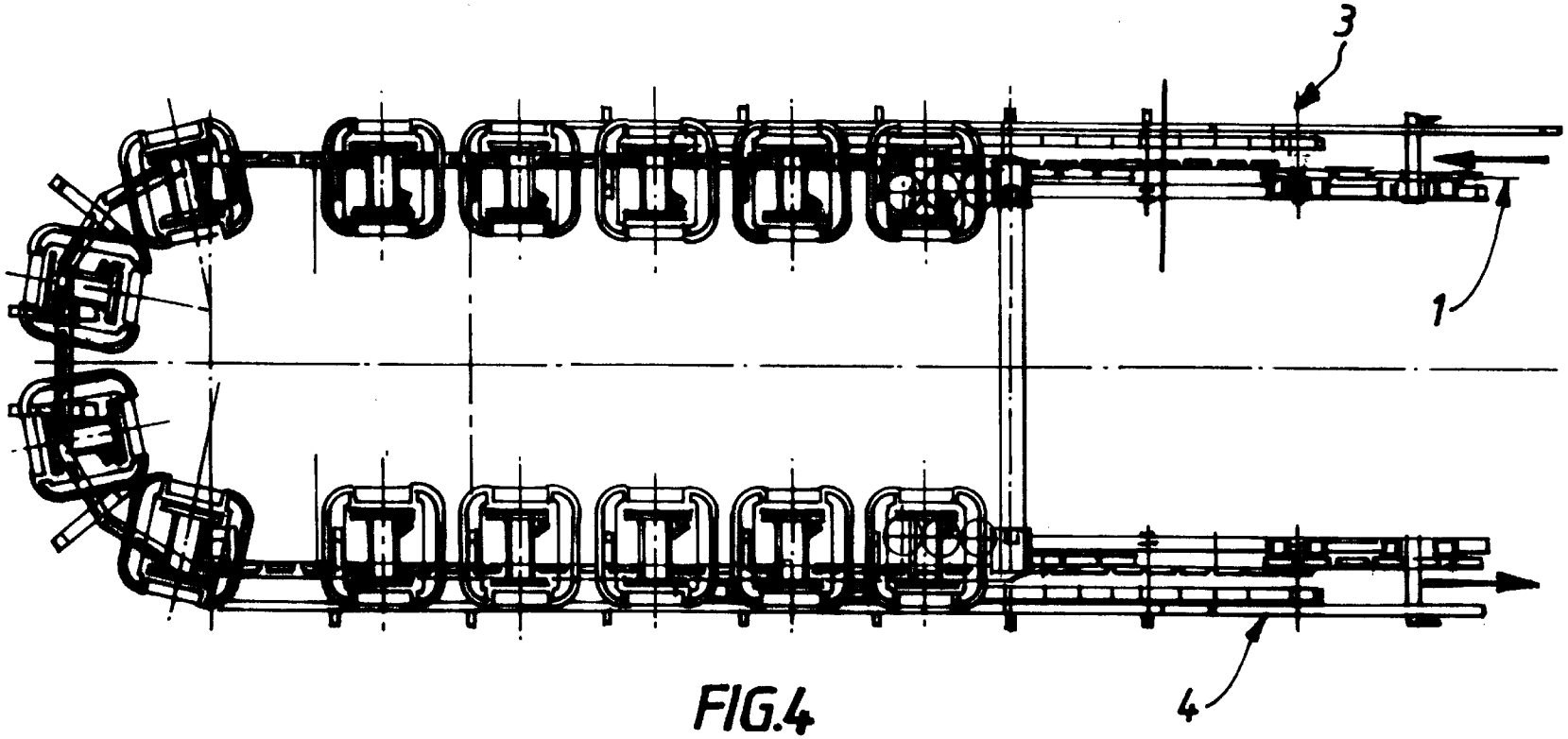

FIG. 4 illustrates a similar situation to that of FIG. 3, in the driving station.

Obviously, according to the respective dimensions of the boarding and arrival stations and of the cars, it may be possible to store more than 14 cars in each station.

The invention enables to use almost all of the lengths of the acceleration/deceleration system and contour for the storage of the vehicles.

According to an embodiment, the process according to the invention is such that the storage speed is kept fairly constant and inferior to the nominal speed of the installation, this storage speed being compatible with the stopping speed of the cars.

According to another embodiment, the process according to the invention is such that the speed fluctuates between the nominal speed and the storage speed.

The invention can be applied on existing equipment, without any important mechanical or electrical modification, the launchers being in particular kept as such.

According to an embodiment, storage tracks of a conventional parking space, under an outbuilding, can be provided, if, for example, it is not possible to store all the cars in the stations.

The friction/brake clutch sets hereinafter referred to as "clutch" are disposed in the mechanisms of the main tracks, in the launcher, the decelerator and the contour.

Each clutch is associated with a car presence detector at the entrance of the disengageable pneumatic.

This detector is, according to an embodiment, of an inductive type.

In the launcher and the decelerator portion, sensors may be used as path controllers.

According to an embodiment, the clutches mainly comprise two coils:

one for the "brake" action (powered coil involving the braking);

one for the "clutch" action (powered coil involving the clutch)

During the normal operating mode, excluding the storage and taking from the stock phases, all the clutches are engaged.

A process control device enables to act on the speed of the cable, during the storage phase, so as to place the cars under the disengageable pneumatics.

Figure 5:
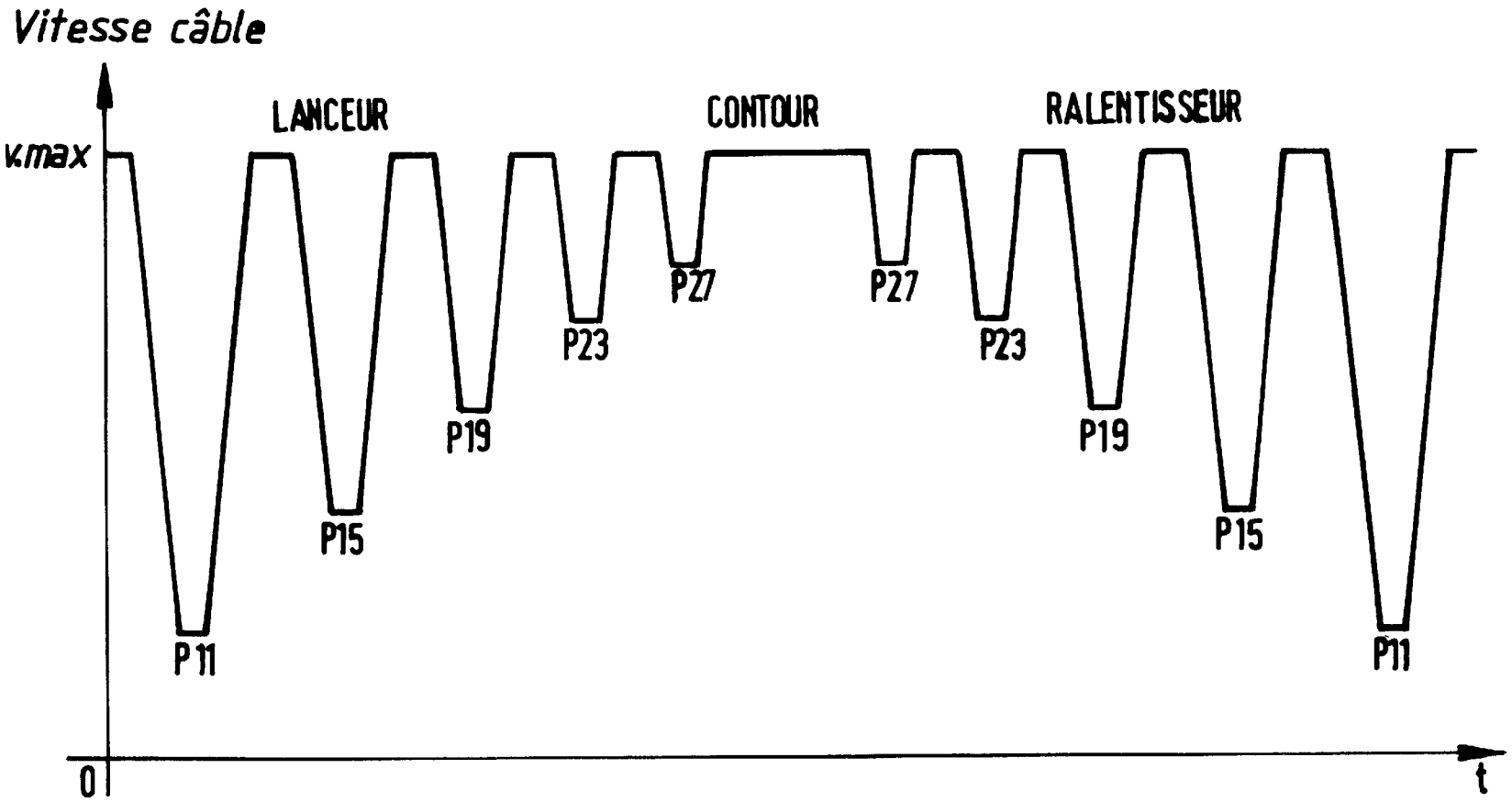
FIG. 5 illustrates the variations of the cable speed in the launcher, contour and braking sections during the implementation of the process according to the invention, in an embodiment.

FIG. 5 illustrates the variations of the cable speed, in the launcher, contour and the decelerator sections. The device can operate in two different ways:

at a constant storage speed, lower than the nominal speed of the apparatus, compatible with the stopping speed of the vehicle, under the storage zone;

at a "pulsed" variable speed.

As a matter of course, every intermediary solution between these two solutions is applicable.

The invention has numerous advantages:

the possibility to keep the motion driving systems on the cable to transmit the necessary power for the acceleration/deceleration systems of the vehicles in the depot of the installation;

during the storage, no imposed pace to be run such as the "step-by-step", no uncoupling of sections;

simplification of the electrical concept of the storage management of the vehicles in the depot;

storage of the vehicles on almost all of the acceleration/deceleration system of the vehicles;

possibility of an operating coupled with a conventional side tracks system, under an outbuilding, for example, if it is not possible to store all the cars in the depots;

possibility to incorporate into an existing installation, without any important mechanical or electrical modification, notably by keeping the launchers as such.

What is claimed is:

1. A process for shutting down a cable-containing aerial transport installation, said installation containing (1) a plurality of cables, at least one of which is a towing cable, and (2) a plurality of cars attached to said cables through at least one disengagable clamp, said process comprising the following steps:

a) braking and stopping a preceding car of said plurality of cars in the vicinity of an exit of a station by engaging car braking and stopping means;

b) transferring a remainder of the plurality of cars present in the station during step a) while keeping the speed of the towing cable approximately constant, c) braking and stopping a following car a predetermined distance from said preceding car by engaging car braking and stopping means associated with said following car, d) transferring remaining cars present in the station during step c) while keeping the speed of the towing cable approximately constant, and e) repeating steps c) and d) so as to store at least some of said plurality of cars along the entire length of the station.

2. The process according to claim 1 wherein the speed of the cars transferred during steps b) and d) is variable between a nominal speed of the cars and a speed of the cars during a storage operation.

3. The process according to claim 1 wherein, steps a) and b) are concomitant and, steps c) and d) are concomitant.

4. The process according to claim 1 further comprising storing said cars on storage tracks located under an outbuilding of said aerial cable transport installation.

5. A process for shutting down a cable-containing aerial transport installation, said installation containing (1) a plurality of cables, at least one of which is a towing cable, and (2) a plurality of cars attached to said cables through at least one disengagable clamp, said process comprising the following steps:

a) braking and stopping a preceding car of said plurality of cars in a vicinity of an exit of a station by engaging car braking and stopping means;

b) transferring a remainder of the plurality of cars present in the station during step a) at a pulsed variable speed, c) braking and stopping a following car a predetermined distance from said preceding car by engaging car decelerating and stopping means associated with said following car, d) transferring the remaining cars present in the station during step c) at a pulsed variable speed, and e) repeating steps c) and d) so as to store at least some of said plurality of cars along the entire length of the station.

6. The process according to claim 2 wherein the speed of the cars transferred during steps b) and d) is variable between a nominal speed of the cars and a speed of the cars during a storage operation.

* * * * *